US005176285A

United States Patent [19]

Shaw

[11] Patent Number: 5,176,285

[45] Date of Patent: Jan. 5, 1993

[54] PILL DISPENSING APPARATUS

[76] Inventor: Thomas J. Shaw, 1510 Hillcrest, Little Elm, Tex. 75068

[21] Appl. No.: 750,878

[22] Filed: Aug. 26, 1991

[51] Int. Cl.[5] ..... B65B 59/00

[52] U.S. Cl. ..... 221/3; 221/13; 221/15; 221/79; 221/82; 221/86; 221/87; 221/113; 221/120

[58] Field of Search ..... 221/2, 3, 4, 5, 9, 13, 221/15, 79, 82, 86, 87, 90, 113, 119, 120, 121, 133

[56] References Cited

U.S. PATENT DOCUMENTS

| | | | |
|---|---|---|---|
| 3,815,780 | 6/1974 | Bauer | 221/15 |
| 3,911,856 | 10/1975 | Ewing | 116/121 |
| 3,985,264 | 10/1976 | Shaw et al. | 221/13 X |
| 3,998,356 | 12/1976 | Christensen | 221/2 |
| 4,207,992 | 6/1980 | Brown | 221/82 X |
| 4,223,801 | 9/1980 | Carlson | 221/3 |
| 4,275,384 | 6/1981 | Hicks et al. | 340/309.4 |
| 4,360,125 | 11/1982 | Martindale et al. | 221/2 |
| 4,473,884 | 9/1984 | Behl | 364/479 |
| 4,572,403 | 2/1986 | Benaroya | 221/3 |
| 4,573,606 | 3/1986 | Lewis et al. | 221/3 X |
| 4,674,651 | 6/1987 | Scidmore et al. | 221/3 |
| 4,695,954 | 9/1987 | Rose et al. | 364/413 |
| 4,809,877 | 3/1989 | Albright | 221/82 X |
| 4,811,764 | 3/1989 | McLaughlin | 221/2 X |
| 4,838,453 | 6/1989 | Luckstead | 221/2 |

*Primary Examiner*—David H. Bollinger
*Attorney, Agent, or Firm*—Hubbard, Thurman, Tucker & Harris

[57] ABSTRACT

An automatic pill dispensing apparatus is provided having a plurality of cartridges mounted on a common rotatable shaft within a housing. Each cartridge has a plurality of compartments disposed about its periphery for containing medication to be dispensed at proper intervals. An alarm is sounded for the user when the cartridges are in position for dispensing medication. A dispense bar is manually actuated by the user to eject medication into a tray for user access. The plurality of cartridges enable filling by a pharmacist of independent multiple prescriptions. The use of a manually automated dispensing bar eliminates the possibility of overdosage by taking accumulated, unused medication. A dislodging wire sweeps through each compartment as the dispense bar is depressed, thereby dislodging the medication from the compartment for user access.

17 Claims, 7 Drawing Sheets

PILL DISPENSING APPARATUS

BACKGROUND OF THE INVENTION

This invention relates to pill dispensing apparatus, and more particularly to an automatic pill dispensing device for dispensing a plurality of pills at selected times over a predetermined period of time.

The use of daily medication is common today, particularly among the elderly. In the United States alone, more than half of those over the age of 65 suffer from chronic aliments which require daily medication. Many of the elderly are in nursing homes or being attended by health care professionals. However, many others must care for themselves and make certain that the medication is given in proper doses and at proper times. This particularly becomes a problem with the elderly who suffer from loss of memory regarding the location and dosage of medication. The elderly frequently also have difficulty opening pharmaceutical containers because of arthritis and other physical impairments.

There is also a difficulty with those who must take a plurality of different medications at the same time. The elderly, in particular, have problems with remembering and dealing with several different medications requiring different doses at different times and frequencies. Such problems may lead to overdosage, under dosage or improper combinations of doses, any one of which can be harmful and even life threatening. The resulting anxiety and loss of peace of mind to both the elderly and their families and friends can hardly be over-estimated.

Numerous devices have been developed for automatically dispensing pills and medication at timed intervals. U.S. Pat. No. 4,207,992 (Brown) discloses a timing mechanism having a dispensing wheel with a plurality of medication storage compartments. Each compartment empties into a hopper which can be accessed by the user.

U.S. Pat. No. 4,573,606 (Lewis et al) discloses a similar device including an alarm means to alert the patient at the time pills are dispensed. U.S. Pat. No. 4,674,651 (Seidmore et al) discloses another such rotating canister apparatus in which pills fall from each compartment into a shoot at given time intervals.

These prior art devices and others do not provide for a means for simultaneously taking several different medications, each having different dosages and time intervals. Although some prior art devices contemplate loading a plurality of pills in each compartment to take care of this problem, such cannot be done legally by a pharmacist, who must load each container with a specific prescription. To the extent that such is done by the patient, it is subject to layman error resulting in incorrect and even harmful doses.

These prior art devices also do not resolve the problem of preventing overdoses. If the medication dropped into the hopper is not taken, it remains there for later consumption when other medication has been added to the hopper. Even with the presence of an alarm, the elderly and others may become confused or may shut off the alarm without taking the medication.

The prior art devices also do not provide for a means of physically removing the pills and medication from each compartment in the rotating cartridge. Pills are frequently gelatin capsules or otherwise succeptable to becoming sticky and adhering to the inside of a cartridge compartment. Consequently, such medication may not easily fall out of a dispensing device at the time needed.

Consequently, there exist a need for a simple and reliable mechanism to dispense a plurality of pill prescription at timed intervals and proper dosages. There is also a need for notifying the user that the pills are ready at the appointed time and for avoiding overdoses by limiting availability of the pills to only the dose to be taken at the time and by keeping an accurate record of all medication taken. There is also a need for having such a system which is easy to operate and maintain, which can be filled by a competent pharmacist and which can automatically operate for a sustained period of time, such as a week, without having to be reset or reloaded.

SUMMARY OF THE INVENTION

Accordingly, the present invention provides for a simple, effective apparatus for dispensing a plurality of medication, each at proper intervals and in proper doses. Moreover, the present invention provides for notification of the user at the time the dosage is ready, avoids overdosage by only making the current dose available and logs a history of all medication provided to the user. The present invention also provides for a means for simply and effectively removing the medication from each compartment in the rotating cartridge, regardless of whether the medication has adhered to the sides of the compartment. Moreover, the present invention provides a means for easily changing the times and frequencies of medication dosages and for easy removal and replacement of rotatable cartridges to expedite being filled by pharmacist.

In one preferred embodiment, the present invention comprises an automatic pill dispenser for dispensing a combination of pills at timed intervals, including a cabinet, a shaft rotatably supported within the cabinet, a plurality of circular cartridges secured on the shaft to rotate therewith. Each cartridge has a plurality of compartments disposed around its circumference for containing pills, and has a dispensing opening therein. An outlet is disposed in the cabinet to simultaneously coincide with a compartment opening in each cartridge as it rotates. A timed motor rotates the shaft periodically to sequentially align each compartment of the plurality of cartridges with the outlet. Thus, a combination of pills in accordance with multiple prescriptions can be periodically dispensed from the plurality of cartridges to the outlet for the user.

In another embodiment, an automatic pill dispenser has a rotating cartridge with a plurality of compartments for containing pills to be dispensed in a time sequence into an opening to be accessed by a consumer. A dispenser bar is disposed adjacent to the opening and is manually actuated by the consumer to remove the pills from each of the compartments as the cartridge rotates each compartment adjacent to the opening. A dislodging wire is attached to the dispensing bar and moves through the compartment adjacent to the opening as the dispensing bar is rotated, thereby dislodging any medication stuck inside the compartment.

The novel features and construction of the present invention, as well as additional objects thereof, will be understood more fully from the following description when read in connection with the accompanying drawings.

DESCRIPTION OF PREFERRED EMBODIMENT

Figure 1A:
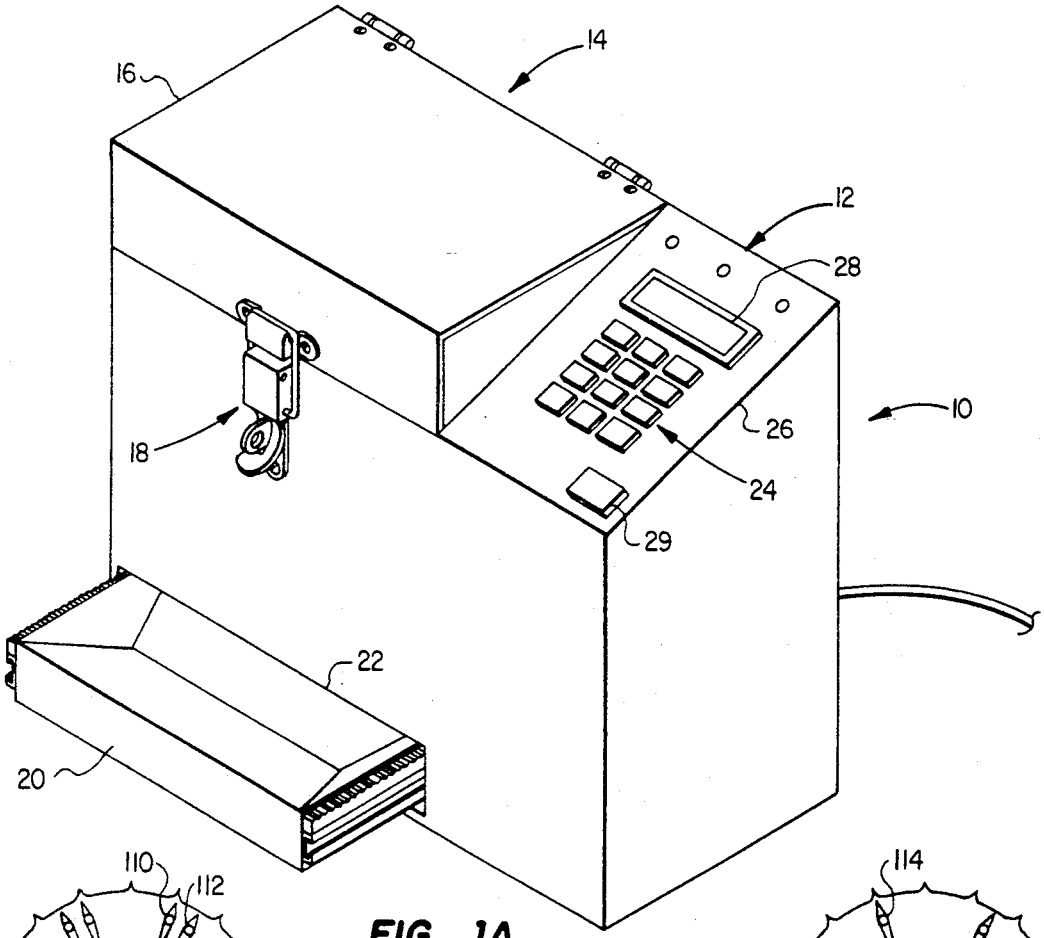
FIG. 1A is a perspective view of the pill dispensing apparatus of the present invention.

Referring now to FIG. 1A, a preferred embodiment of the pill dispensing apparatus of the present invention is depicted therein. The pill dispensing apparatus 10 includes a housing 12 having a mechanical section 14, accessible by a hinged lid 16 which is locked in place by a clamp 18. A dispensing tray 20 retracts and extends within a rectangular slot 22 in the base of housing 12.

A key pad 24 is disposed on a slanted upper surface 26 of housing 12. An electronic display window 28 is provided in the slanted surface 26 above key pad 24. An actuator button 29 is also located in slanted surface 26 for mechanically actuating a dispensing bar, to be discussed later. A conventional printer may also be included (not shown) for printing out a record of the medication taken. A computer and electronic circuitry (not shown) are also provided in housing 12, as discussed herein with regard to FIG. 6.

Figure 1B:
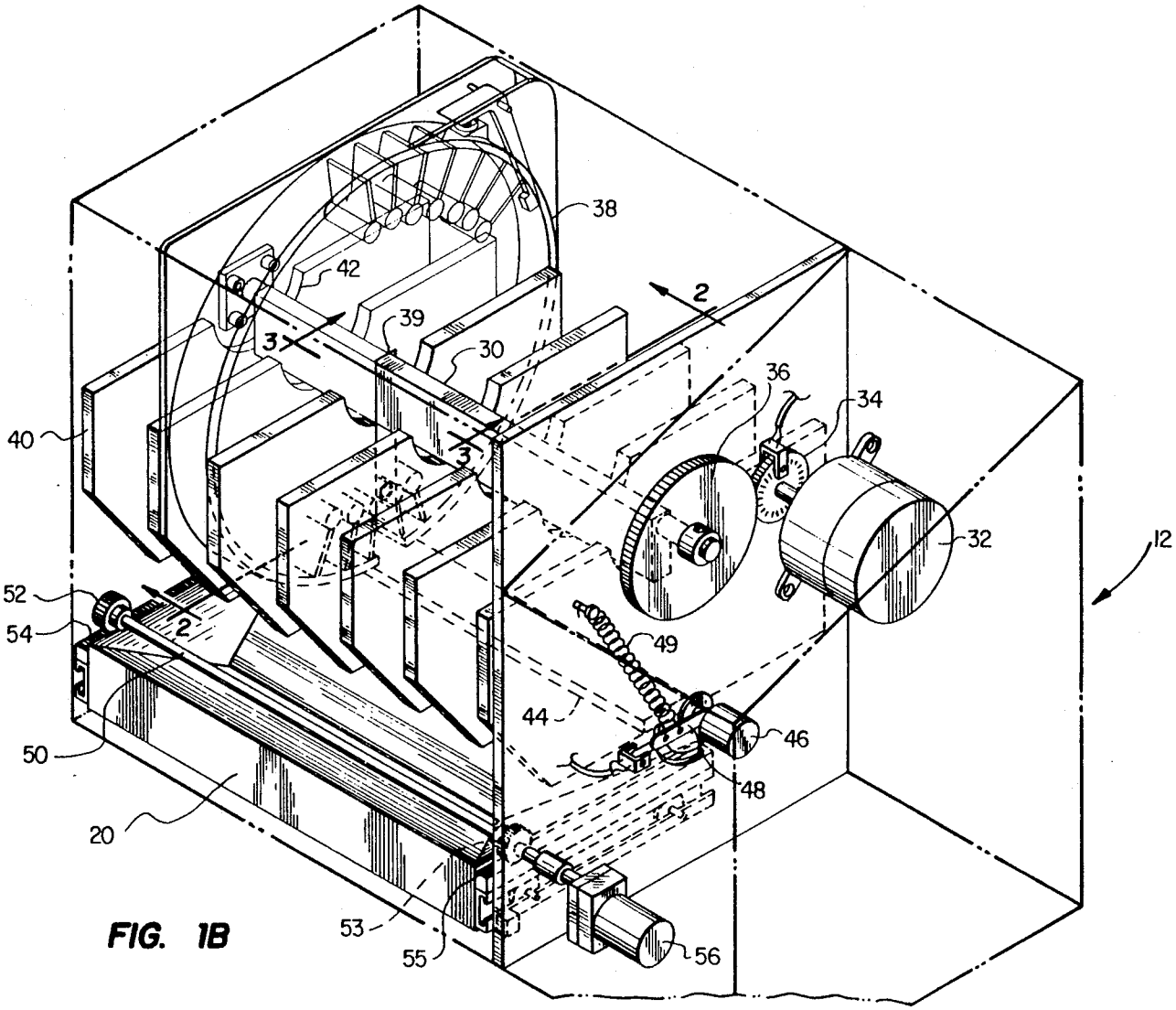
FIG. 1B is a partially cut away perspective view of the mechanical portion of the automatic pill dispenser shown in FIG. 1.

Looking now at FIG. 1B, the mechanical structure of the pill dispensing apparatus shown in FIG. 1A is depicted. A rectangular shaft 30 is disposed horizontally within housing 12 and is driven by an electrical motor 32 through gears 34 and 36. A plurality of circular cartridges 38 having rectangular slots 39 therein are mounted on shaft 30 to rotate therewith. Between each set of adjacent cartridges 38 is a divider plate 40 having a hemispherical cut out 42 in its center to accommodate rotation of shaft 30.

A dispensing bar 44 is pivoted by a small circular motor 46 by means of a pivot arm 48 extending horizontally out from the shaft of motor 46. A spring 49 biases pivot arm 48 to return it to the horizontal position after actuation by motor 46. The spring thereby holds the dispensing bar 44 tightly in the groove on the cartridge 38 as will be discussed later.

Tray 20 is shown in its retracted position. A longitudinal shaft 50 includes threaded wheels 52 and 53 mounted on threaded tracks 54 and 55 at the top of either end of tray 20. Shaft 50 is rotated by motor 56, upon actuation, to horizontally extend or retract tray 20.

Figure 4:
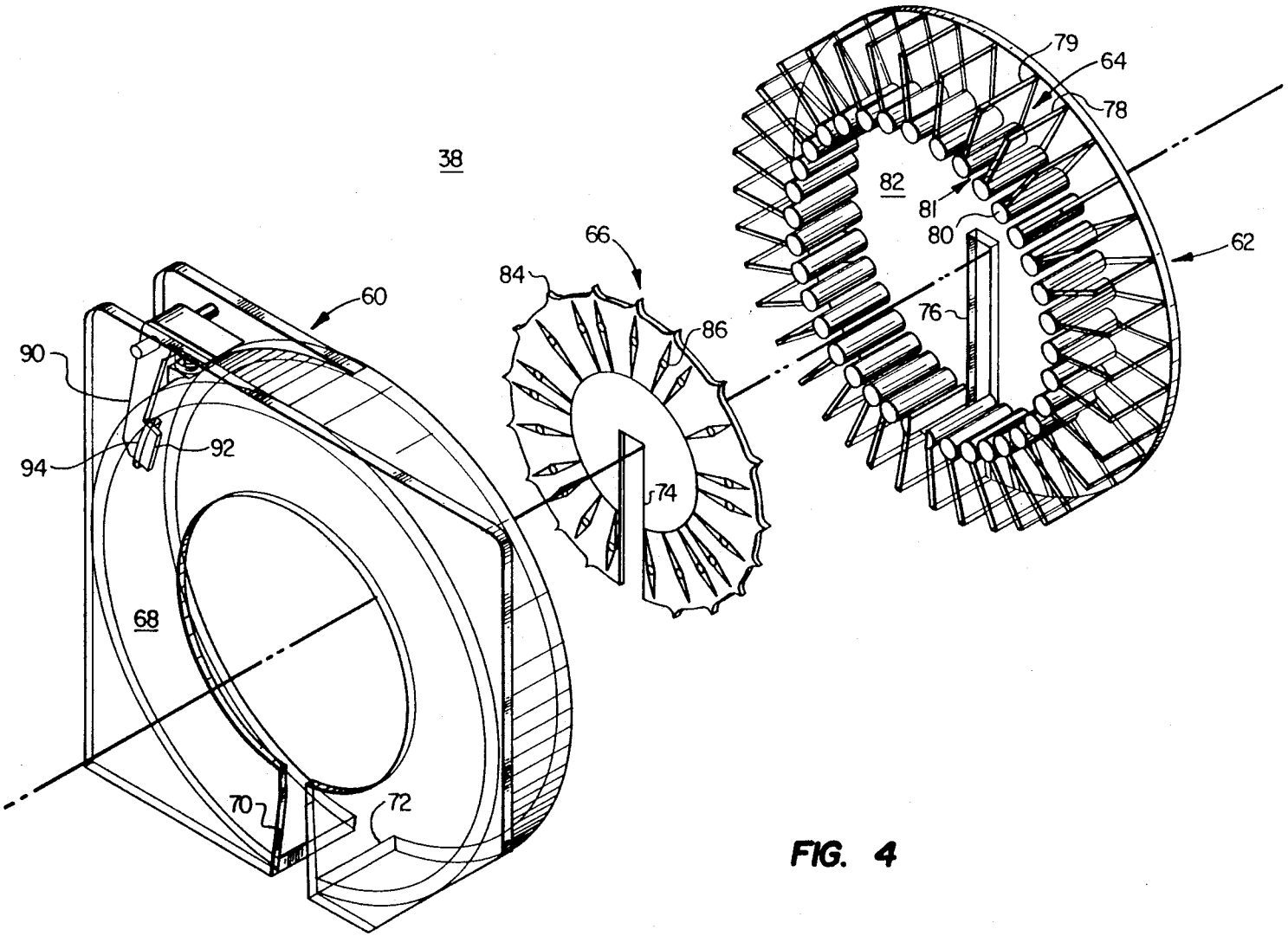
FIG. 4 is an exploded, perspective view of the cartridge.

Looking now at FIG. 4, cartridge 38 comprises three elements, an outer housing 60, a rotatable inner unit 62 having multiple compartments 64 therein and a flat template 66 positioned between the outer casing 60 and rotatable unit 62. Casing 60 is shaped cylindrically to receive rotatable unit 62 therein so that each compartment 64 is closed at its periphery by the inner cylindrical surface 68 of casing 60. A vertical slot 70 is cut into the side face of casing 60 and adjoins with a horizontal slot 72 at the base of the housing of casing 60. Similar vertical slots 74 and 76 are cut into template 66 and rotating unit 62, respectively. Slot 70, 74 and 76 are used to mount the components of cartridge 38 on rectangular shaft 30, as shown in FIG. 1B.

A rotatable unit 62 comprises a plurality of radially extending walls 78, each of which extend from a post 80 disposed parallel to wall 78 and extending perpendicular from back wall 82 of the rotatable unit 62. The plurality of posts 80 and walls 78 and 79 form open-ended compartments 64. When assembled with casing 60, the compartments 64 of rotatable unit 62 are closed off at the periphery by the inner circular surface 68 of casing 60. The other end of compartment 64 are partially closed off by adjacent post 80, leaving a slot 81 between post for use to be described later.

Template 66 includes a plurality of points 84 around its periphery for mounting in slots 81 of rotatable unit 62. A plurality of holes 86 are punched in the template at strategic points so as to indicate the frequency and timing of dosages for the medication, as will be described later.

Figure 2A:
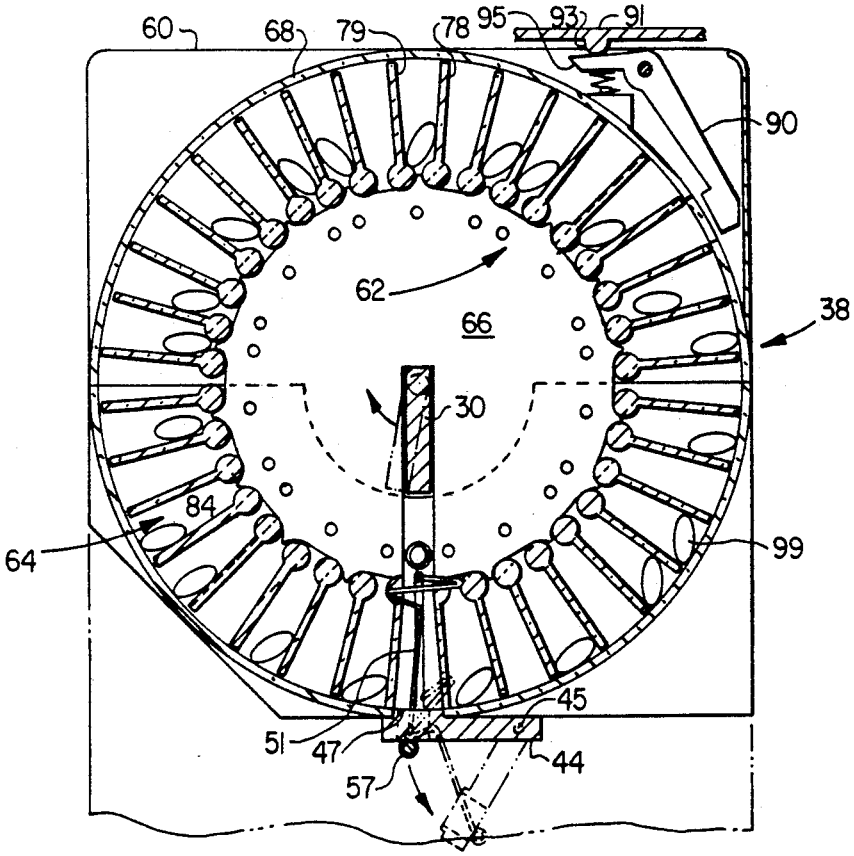
FIG. 2A is a cross-sectional view taken along line 2—2 shown in FIG. 1B.
Figure 2B:
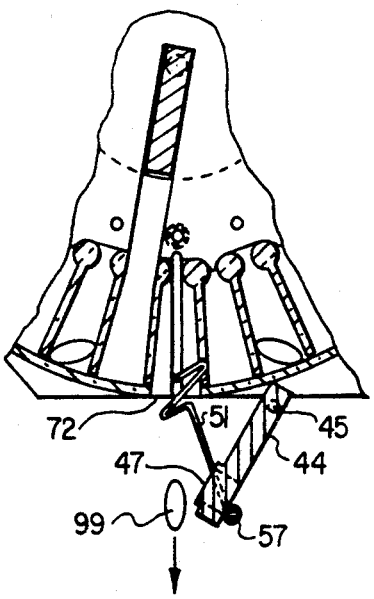
FIG. 2B is a cutaway partial view of a portion of the cross section shown in FIG. 2A.

Looking now at FIGS. 2A and 2B, a cartridge 38 is shown mounted on shaft 30. Rotatable unit 62 is shown mounted within casing 60 with side faces 78 and 79 abutting the inner circular surface 68 of casing 60. Template 66 is mounted with tips 84 between slots 81 of compartment 64.

A dispenser bar 44 is shown horizontally disposed to pivot about pivot point 45. The dispenser bar 44 is horizontally disposed with a surface 47 positioned to engage slot 72 of cartridge casing 60. This seals off slot 72 and prevents pills 99 from dropping out of slot 72. A dislodging wire 51 is rotatably mounted on the far end of dispenser bar 44 and extends upward behind compartments 64 as shown. The wire is bent to provide strength as it rides back and forth through compartment 64.

As shown in FIG. 2B, dispenser bar 44 may be pivoted toward a horizontal position about pivot point 45, thereby removing the surface 47 from slot 72 of the cartridge casing 60. This allows pill 99 to fall downward with the force of gravity and out of compartment 64. Wire 51 is pulled down through compartments 64 to assist in dislodging pill 99 as needed. As can be seen, wire 51 is rotatably mounted on hinge 57 to extend through a slot in dispenser bar 44.

Figure 3:
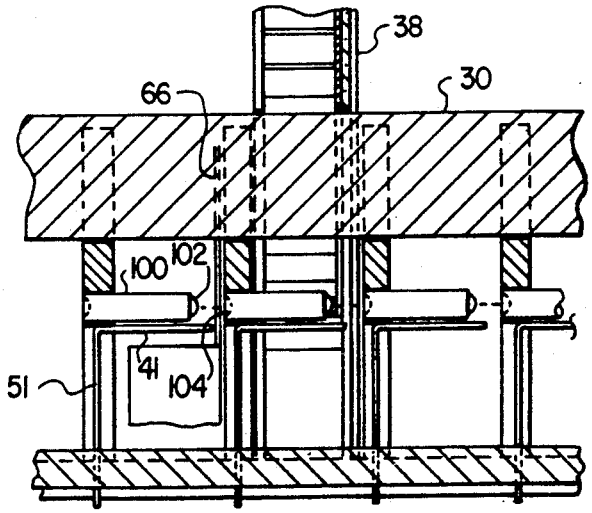
FIG. 3 is a partial cross section taken along line 3—3 of FIG. 1B.

Referring now to FIG. 3, a cross section is shown along line 3—3 from FIG. 1B. Shaft 30 is shown with cartridge 38 mounted thereon. Wires 51 extend radially between adjacent cartridges 38 and include a perpendicularly extending end piece 41 which is used to sweep through compartment 64 upon rotation of dispenser bar 44. A photoelectric cell 100 includes a transmission end 102 projecting a light to the receiver end 104 of the next photoelectric cell 100. Template 66 moves between transmitter 102 and receiver 104 and blocks off the light path except when a hole 86 rotates into the light path. At that point, the photocell light path connection is complete and the appropriate electronic circuit registers in the presence of a pill in the appropriate compartment 64.

Figure 5A:
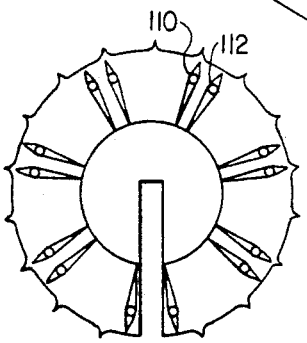
FIGS. 5A-5E are side views of different embodiments of the template used in the cartridge of FIG. 4.
Figure 5D:
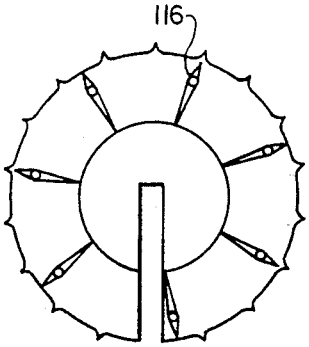
Figure 5B:
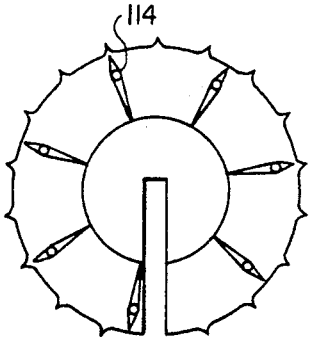

FIGS. 5A-5E show variations on the template configuration to accommodate different prescriptions. FIG. 5A shows two adjacent holes 110 and 112 indicating two doses per day for seven days. FIG. 5B has seven evenly spaced holes 114 indicating a single dose once each day. FIG. 5D shows a similar configuration of evenly spaced holes 116, indicating one dose per day, at different times of the day.

Figure 5C:
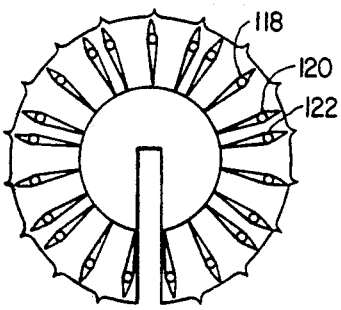
Figure 5E:
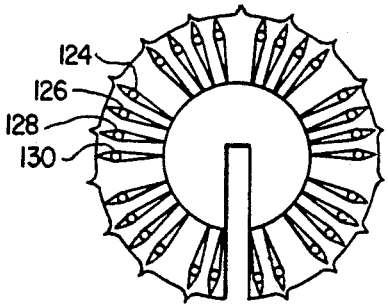

FIG. 5C shows seven groupings of three holes 118, 120 and 122 indicating three doses per day. In FIG. 5E the template has seven groups of 4 holes 124, 126, 128 and 130 indicating four doses per day.

Ideally, the cartridge 38 are each removed from the rectangular shaft 30 and loaded by a home health car provider or taken to a pharmacist to be refilled, and the correct template is selected. Preferably, if the cartridges are loaded by a pharmacist, they are sealed and not opened or breached by anyone, thus insuring the integrity of the medication and dosage.

As best seen in FIG. 4, a wheel lock may be added as an option. A wheel lock arm 90 is mounted on casing 60 and spring-biased to have an end 92 extend through an opening 94 in circular casing surface 68 to engage 78 and 79. In this manner, the cartridge lock arm 90 prevents rotation of rotatable unit 62 whenever arm 90 is spring biased to extend arm end 92 through slot 94. As seen in FIG. 2A, with cartridge 38 loaded in housing 12, a housing door 91 includes a nub 93 which impacts against the small lever arm 95 of spring biased cartridge lock 90. This action rotates cartridge lock arm 90 to remove its end 92 from slot 94 and allow rotation of rotatable unit 62 within housing 60. Thus, the rotatable unit can rotate when it is loaded in position on shaft 30 but is locked so as to not rotate when the cartridge 38 is removed from housing 12.

The pill dispenser apparatus of the present invention is operated by first imputing the appropriate time and date on key pad 24. Once each week the machine is reloaded and reset as needed. The prescription number for each of the cartridges is also entered in the key pad, as well as the dosage amount and frequency. A major advantage is that the dispensing times and dates are controlled by the templates and do not have to be input through the keypad. Also, for further simplicity, the key pad need not be alphanumeric. The prescription number and pharmacist telephone number is input, which provides a way to determine the prescription name if necessary. Alternatively, of course, the dispensing times and dates, as well as the prescription names, may be input for computer control if desired.

After the appropriate information is entered, the machine makes one pass to make sure that the dosage you put in the machine for each wheel matches with the template on the wheels. If everything is correct, the machine goes into its normal interval functions.

Using the present preferred embodiment, up to six cartridges may be loaded on shaft 30. The machine indexes through a rotation cycle of the shaft and cartridges on the following schedule; 4 hours, 2 hours, 2 hours, 4 hours and 12 hours. As an example, the machine preferably indexes the shaft by beginning to count at 8 am. Four hours later at noon, the shaft indexes to the next position. Two hours later at 2 pm the shaft indexes to the next position. Two hours later at 4 pm, the shaft again indexes and four hours later at 8 pm, the shaft rotates again. Finally, the shaft does not index for twelve hours until 8 am the next day, thus beginning a new daily cycle.

With this combination, one may have medication dispensed once a day, twice a day, three times a day or four times a day. Once-a-day medication may be dispensed at whatever time is designated. Twice-a-day medication is dispensed at 8 am and 8 pm. For medication to be taken three times a day, dispensing occurs at 8 am, 2 pm and 8 pm. Medicine is dispensed four times a day at 8 am, 12 noon, 4 pm and 8 pm. Thus, all combinations are covered by these five index positions. Of course, the apparatus may be reprogrammed to accommodate any combination or frequency necessary.

With the preferred embodiment, there are five possible dispensing times per day. Thus, 35 pill compartments are used for dispensing pills each week. Each cartridge is divided into 36 compartments, each having ten-degree angles. All the wheels index together at the same time as they all rotate commonly with shaft 30. As the shaft rotates to each new position, if medication has been provided in the appropriate compartments aligned with slot 72 in the casing, an alarm will alert the user who can then depress the dispenser bar and obtain all medication dropped from each of the compartments in each wheel which is aligned with slot 72.

If the user does not actuate the dispenser bar, the medication remains in each wheel as it indexes to the next step. Thus, no extra medication collects in the tray of the apparatus and there is no possibility of inadvertently taking an overdose. Moreover, at the end of the seven-day medication cycle, a person refilling the prescription can determine by the amount of medication left in each wheel what was missed by the user and take appropriate remedial steps.

When the medication becomes available to the user, the user actuates the dispenser bar 44 by pushing button 29 on the key pad. This action also actuates tray motor 56 which extends tray 20 outward for the user to obtain the medication. After the medication has been taken, the tray is retracted by pushing the dispense button or will be automatically retracted before the next dispense cycle.

Preferably at the time of each dosage, the machine will display and/or printout the date and time and the prescription or prescription number. Another display or print out may be obtained on demand giving the prescription number, the pharmacy number and the dosages taken for the week.

Figure 6:
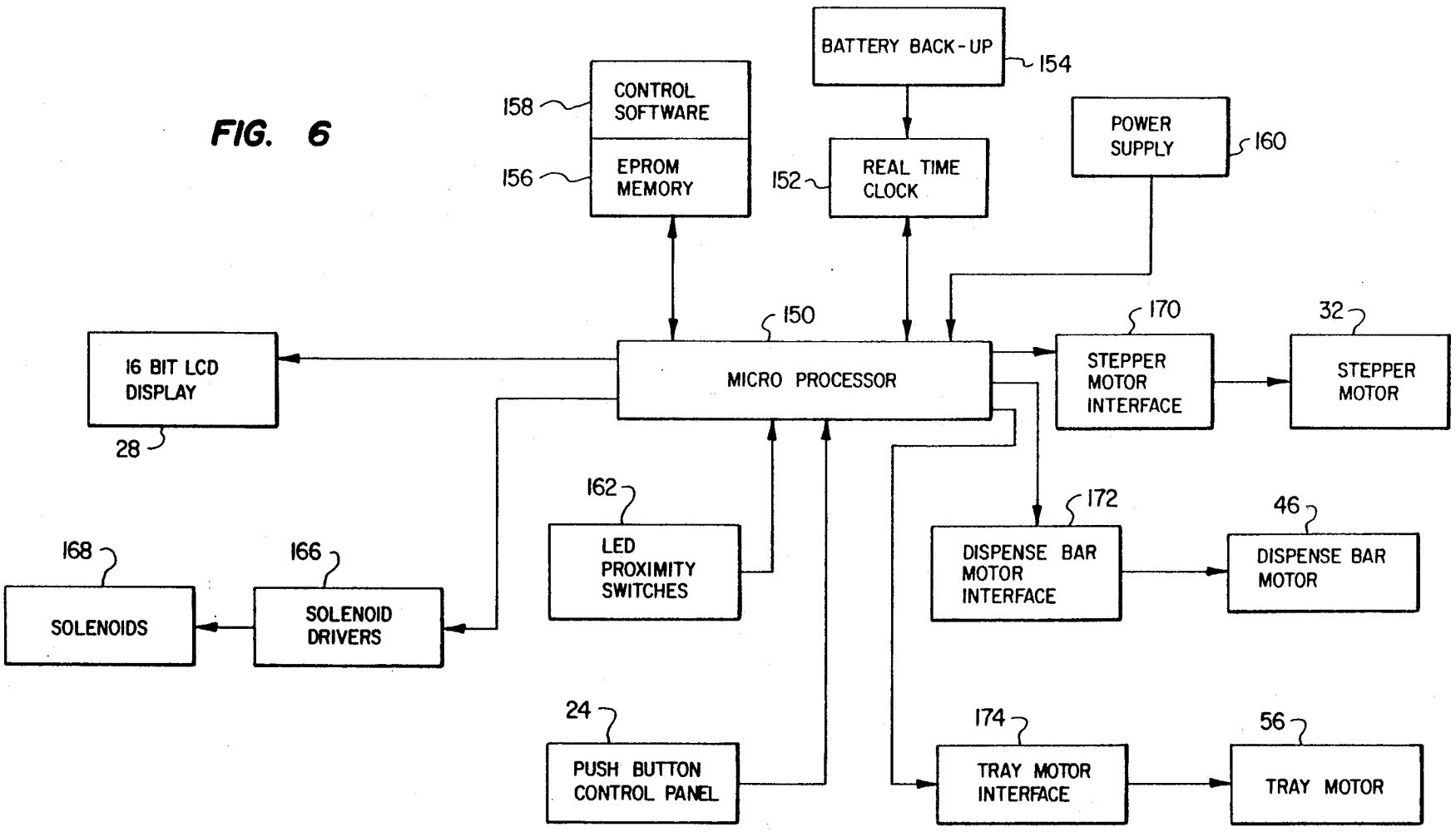
FIG. 6 is a block diagram of the computer and electronics of the preferred embodiment of the invention.

The computer and electronic circuitry for the present invention are conventional or can be provided and designed to carry out the operation of the present invention by an ordinary technician. Preferably many of the functions are programmed into a conventional computer as described herein. FIG. 6 shows a block diagram of a preferred embodiment of the computer and electronic circuitry of the present invention.

Referring to FIG. 6 in more detail, the center of the electronic circuitry is microprocessor 150, preferably Intel model 8051. The microprocessor is fed by a real-time clock 152, preferably model 146818 made by Motorola. The clock has a battery back-up 154 made by Dallas Semiconductor model 1210.

Microprocessor 150 interfaces with EPROM memory 156, preferably model 27C256 which is controlled by software 158 as will be discussed hereafter. The entire circuit is powered by a conventional AC/DC power supply 160 through a main bus associated with microprocessor 150. A push button control panel 24 and LED proximity switches 162, which are actuated by photo electric cells 100, feed input information to microprocessor 150.

Microprocessor 150 outputs information to LCD display 28 shown in FIG. 1A. Actuation signals are also outputted to solenoid drivers 166, preferably integrated circuit model 75468, which drive solenoids 168 that actuate the dispense bar and the door latch.

Microprocessor 150 also outputs signals to stepper motor interface 170, preferably Motorola model 1042A. Stepper motor interface 170 sends actuation signals to stepper motor 32, shown in FIG. 1B, which is used to rotate rectangular shaft 30 on which the circular cartridges 38 are mounted. Dispense bar interface 172 and tray bar interface 174, both preferably integrated circuit 75468, interconnect microprocessor 150 with the dispense bar motor 47 and the tray motor 57, respectively.

Figure 7A:
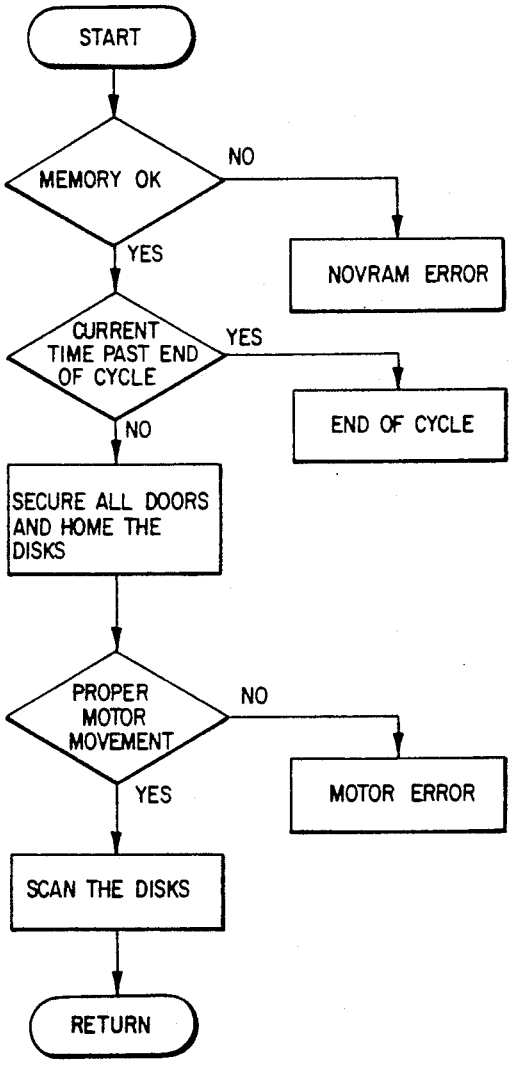
FIGS. 7A-7E are flow diagrams showing the operation of a preferred embodiment of the present invention.
Figure 7B:
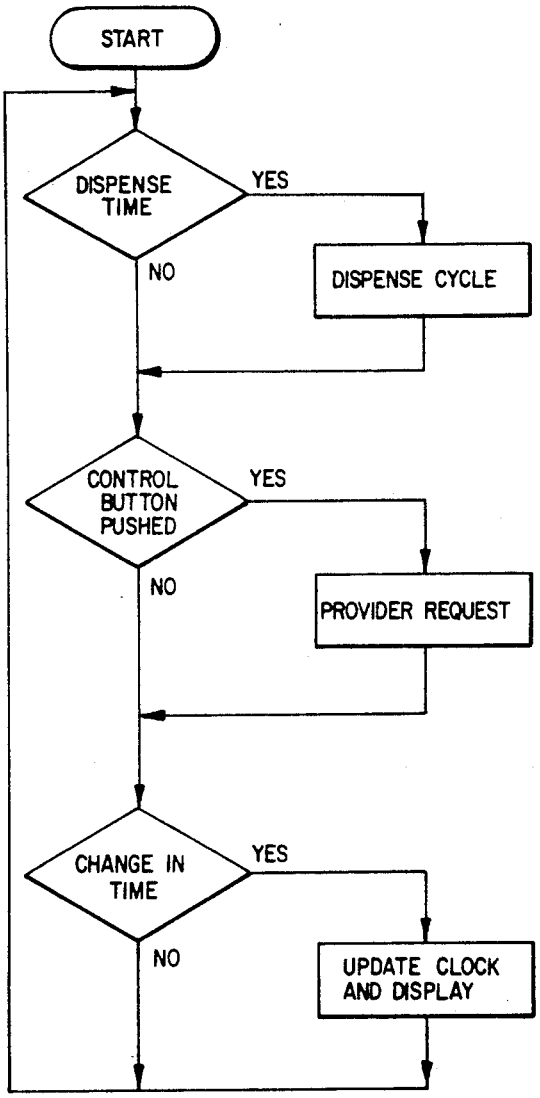

FIGS. 7A-7E show flow diagrams of a preferred embodiment for carrying out the computer software 158 and whatever other programs, if any, that there may be in microprocessor 150 and interfaces 170, 172 and 174. FIG. 7A shows a power-up reset cycle in which a memory check is first made and the current time is checked against the cycle. All doors are secured and the motor is checked for proper movement. Then the disk or cartridges are scanned by rotating them 360 degrees and inputting to the computer the dosage frequency information provided by the template holes. The computer then confirms that this information matches the dosage frequency information which was inputted to the computer from the keypad. FIG. 7B gives an overview of the operating loop cycle. When a dispense time is detected the dispense cycle is carried out. When the control button is pushed a provider request cycle is enabled. If the time has changed, the clock and display are updated.

Figure 7C:
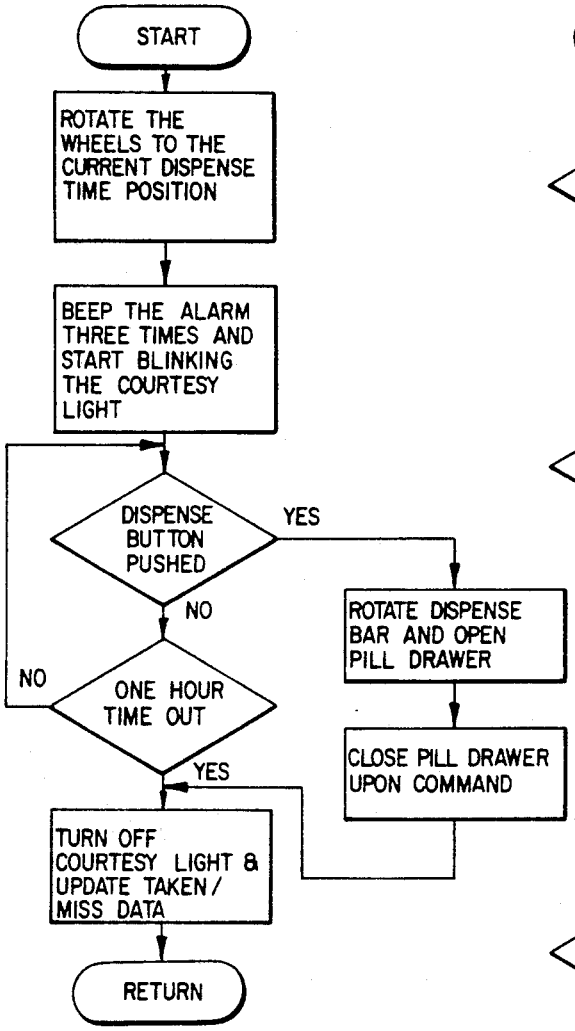

With reference now to FIG. 7C, the dispense cycle is shown in greater detail. The wheels are rotated to the current dispense time position and the alarm is sounded to begin operation. When the dispense button is pushed, the dispense bar is rotated and the pill drawer may be opened and closed upon command. If the dispense button is not pushed, there is a one hour time out and the dispense bar is locked to prevent late use by the user. The record is updated regarding the medicine taken.

Figure 7D:
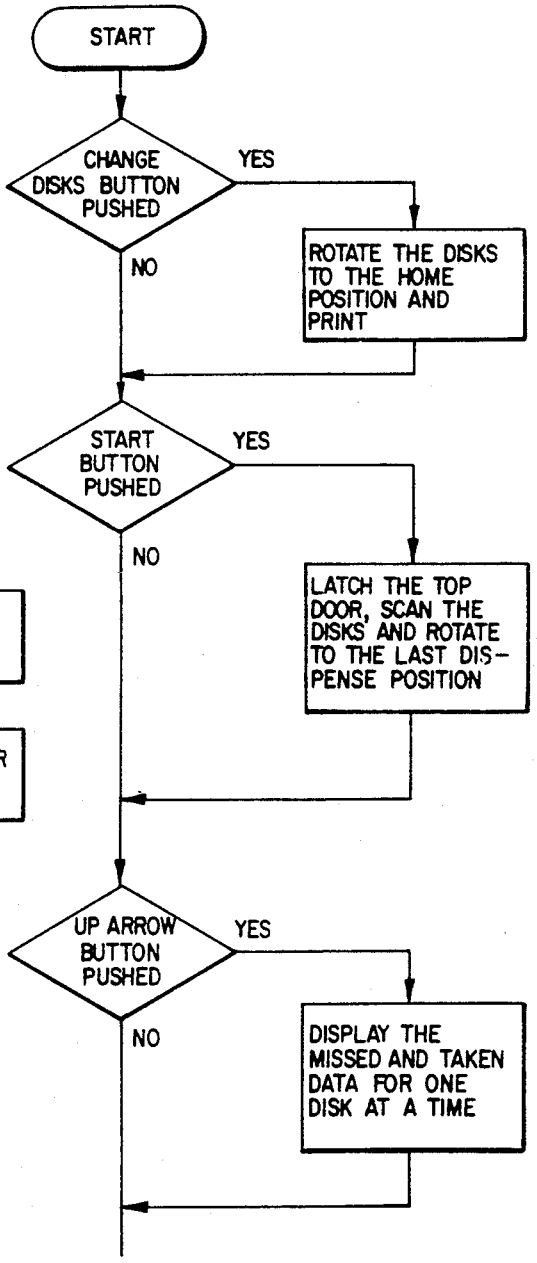
Figure 7E:
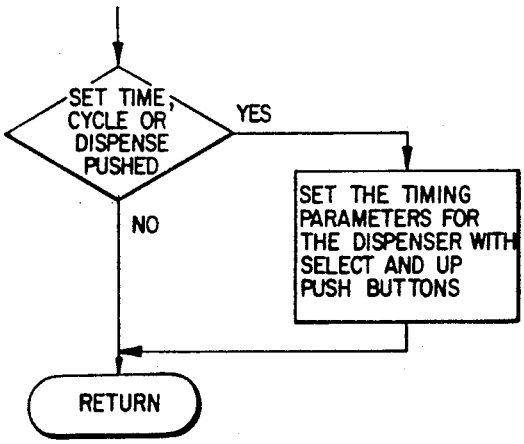

Referring now to FIGS. 7D and 7E, the provider request cycle is shown. When the disk or cartridges are changed, they are rotated to the home position and a printout is made of the prescription of each. After the cartridges have been replaced, the start button is pushed, the top cover is latched and the cartridge templates are scanned and rotated to the last dispense position. Template scanning is carried out to confirm dosage frequency information as previously discussed. At any time during the week, the "up arrow" button on the keypad may be pushed to scan the cartridges separately to determine what dosages were taken or missed. Finally as shown in FIG. 7E, the time and cycle of the cartridges may be adjusted by pushing appropriate buttons on the keypad.

While the preferred embodiment of the invention has been illustrated and described, those skilled in the art can easily make changes without departing from the spirit and scope of the invention.

What is claimed is:

1. An automatic pill dispenser for dispensing a combination of pills at timed intervals comprising:

(a) a cabinet, (b) a shaft rotatably supported within said cabinet, (c) a plurality of independent circular cartridges mounted on said shaft to rotate therewith, said cartridges being independently removable from said cabinet without interfering with the operation of any other remaining cartridge, (d) each independent cartridge having a plurality of compartments for containing pills disposed around its circumference, each compartment having a dispensing opening therein, which is alignable with an outlet within the cabinet, (e) an outlet mounted in said cabinet disposed to simultaneously coincide with a dispensing opening in a compartment of each cartridge as the plurality of cartridges rotate, and (f) timed drive means to rotate said shaft periodically to sequentially align the dispensing opening of each compartment of the plurality of cartridges with said outlet whereby a combination of pills may be periodically dispensed simultaneously from said plurality of cartridges to said outlet in accordance with multiple prescriptions.

2. An automatic pill dispenser for dispensing a combination of pills at timed intervals comprising:

(a) a cabinet, (b) a shaft rotatably supported within said cabinet, (c) a plurality of circular cartridges secured on said shaft to rotate therewith, (d) each cartridge having a plurality of compartments for containing pills disposed around its circumference, each compartment having a dispensing opening therein, (e) an outlet mounted in said cabinet disposed to simultaneously coincide with a compartment opening in each cartridge as it rotates, including manually actuable dispensing means at said outlet for enabling said compartment openings coinciding with said outlet to register with said outlet and thereby dispense the pills from said compartment to said outlet, and (f) timed drive means to rotate said shaft periodically to sequentially align each compartment of the plurality of cartridges with said outlet whereby a combination of pills are periodically dispensed from said plurality of cartridges to said outlet in accordance with multiple prescriptions.

3. The dispenser of claim 2 wherein said dispensing means is an dispensing bar extending parallel with said shaft transverse to the circumference of said plurality of cartridges and having a plurality of pill impeller wires, each adjacent to one of said compartments for extending into said compartment and ejecting the pills therein upon actuating of the dispensing bar.

4. The dispenser of claim 2 and further comprising indicator means with each cartridge for indicating the compartments within which pills are contained, and means for sensing said indicator means to determine when a compartment containing a pill coincides with said outlet.

5. The dispenser of claim 4 wherein said indicating means is a template having a plurality of indicators thereon each associated with a pill-containing compartment, and said sensing means is a sensor for determining the presence of one of said indicators adjacent to said outlet.

6. The dispenser of claim 4 and further including annunciator means for signaling that a pill-containing compartment coincides with said outlet.

7. The dispenser of claim 4 and further including means for recording each activation of said dispensing means whereby pills are dispensed to said outlet.

8. An automatic pill dispenser for dispensing a combination of pills at timed intervals comprising:

(a) a cabinet, (b) a shaft rotatably supported within said cabinet, (c) a plurality of circular cartridges secured on said shaft to rotate therewith, (d) each cartridge having a plurality of compartments for containing pills dispensed around its circumference, each compartment having a dispensing opening therein, (e) an outlet mounted in said cabinet disposed to simultaneously coincide with a compartment opening in each cartridge as it rotates, said dispensing opening further comprising ejection means associated with said dispensing opening for dislodging pills stuck in said compartments to facilitate the dispensing of the pills to said outlet, and (f) timed drive means to rotate said shaft periodically to sequentially align each compartment of the plurality of cartridges with said outlet whereby a combination of pills are periodically dispensed from said plurality of cartridges to said outlet in accordance with multiple prescriptions.

9. A medication dispensing apparatus for periodically providing a plurality of medication doses each having its own periodic dosage frequency, comprising:

(a) a single rotatable shaft;

(b) timed drive means for rotating said shaft periodically, (c) a plurality of independently dispensing medication cartridges each mounted on said shaft for unitary rotation therewith;

(d) a plurality of compartments in each cartridge for selectively containing a medication having its own periodic dosage frequency which may differ from the dosage frequency of one or more of the other cartridges;

(e) means for periodically, and simultaneously opening a compartment in each cartridge which selectively may contain a medication according to said dosage frequency, all of said compartments being aligned with each other to release any medication dosage therein; and (f) means for collecting any medication dosage released from said compartments.

10. A medication dispensing apparatus for periodically providing a plurality of medication doses each having its own periodic dosage frequency, comprising:

(a) a single rotatable shaft, (b) timed drive means for rotating said shaft periodically, (c) a plurality of medication cartridges each mounted on said shaft for unitary rotation therewith, (d) a plurality of compartments in each cartridge for containing said medication dosages, wherein each compartment has an opening means therein and said opening means comprises means to selectively register the openings of aligned compartments of said multiple cartridges for release of said medication dosages into said receiving means, (e) means for periodically opening a compartment in each cartridge, all of which are aligned with each other to release the medication dosage therein; and (f) means for receiving the medication dosages released from said compartments.

11. An automatic pill dispenser for selectively dispensing pills at time intervals and retaining pills that have not been dispensed, comprising:

(a) a housing having an opening therein leading to a pill drawer which is accessible to a person needing periodic medication;

(b) multiple storage means within said housing each having multiple compartments for storing one of said pills in selected ones of said compartments, each of said compartments having an opening therein for removing said pills simultaneously from a multiple compartment of each storage means in response to (1) periodic relative movement between said storage means and said housing to locate successive compartments of each storage means in line with the opening in the housing for a timed interval and (2) activation of a selective activator means during said timed interval;

(c) selective activator means in said housing disposed proximate to said storage means, which can be activated by a person needing medication, for removing each of said pills from its respective compartment through said housing opening into the pill drawer at predetermined times corresponding to said periodic relative movement between said storage means and said housing if said activator means is activated during said timed interval; and (d) said selective activator means being ineffective to remove said pills from successive compartments of said storage means that had been in line with said opening, if said activator means had not been activated during said timed interval.

12. The pill dispenser of claim 11 wherein said storage means comprises a rotatable cartridge having a plurality of compartments about its periphery, each having an open end at its periphery for movement past the housing opening.

13. An automatic pill dispenser for dispensing pills at time intervals, comprising:

(a) a housing having an opening therein, (b) storage means within said housing with multiple compartments for each storing one of said pills, each of said compartments having an opening therein for removing said pill, wherein said storage means comprises a rotatable cartridge having a plurality of compartments about its periphery, each having an open end at its periphery for movement past the housing opening, and (c) activator means in said housing disposed proximate to said storage means for removing each of said pills from its respective compartment through said housing opening at predetermined times, wherein said activator means comprises a dispenser bar disposed adjacent to said housing opening and actuable to move away from said housing opening to release said pill from said compartment having its open end adjacent said housing opening.

14. The pill dispenser of claim 13 and further comprising timing means to rotate said cartridge within said housing within a predetermined period of time.

15. The pill dispenser of claim 14 and further including sensor means to determine the presence of said pill in the compartment adjacent said opening, and of alarm means responsive to said sensor means to signal that said pill has been sensed.

16. In an automatic pill dispenser having a rotating cartridge with a plurality of compartments for containing pills to be dispensed in timed sequence into an opening to be accessed by a consumer, the improvement comprising dispenser means manually actuable by the consumer to remove the pills from each one of the compartments as the cartridge rotates to dispose said one compartment adjacent to said opening, wherein said dispenser means comprises a dispenser member adjacent said opening and moveable to enable removal of the pills from said one compartment adjacent to said opening, and further including sweeping means for moving through said one compartment as said dispenser member is moved to facilitate removal of said pills.

17. The auto dispenser of claim 16 wherein said sweeping means comprises a wire attached to said dispenser member and extending to move through said compartment as said dispenser member is moved.

* * * * *

UNITED STATES PATENT AND TRADEMARK OFFICE

CERTIFICATE OF CORRECTION

PATENT NO. : 5,176,285
DATED : January 5, 1993
INVENTOR(S) : Thomas J. Shaw

It is certified that error appears in the above-identified patent and that said Letters Patent is hereby corrected as shown below:

In column 2, line 5, add --s-- at the end of "scription".

In column 4, line 44, delete "s" at the end of "compartments".

In column 5, line 7, add --s-- at the end of "cartridge".

In column 5, line 8, add --e-- at the end of "car".

In column 8, line 44, add --s-- at the end of "compartment".

Signed and Sealed this

Thirtieth Day of November, 1993

Bruce Lehman

*Attest:*

BRUCE LEHMAN

*Attesting Officer*

*Commissioner of Patents and Trademarks*